US005653551A

United States Patent [19]

Seaux

[11] Patent Number: 5,653,551

[45] Date of Patent: Aug. 5, 1997

[54] MAT SYSTEM FOR CONSTRUCTION OF ROADWAYS AND SUPPORT SURFACES

[76] Inventor: Ores Paul Seaux, P.O. Box 52201, Lafayette, La. 70505

[21] Appl. No.: 541,083

[22] Filed: Oct. 11, 1995

[51] Int. Cl.[6] ..... E01C 5/18

[52] U.S. Cl. ..... 404/35; 404/44; 404/41

[58] Field of Search ..... 404/34, 35, 36, 404/41, 44, 45, 33, 32; 52/756.1, 177, 551.4, 551.5

[56] References Cited

U.S. PATENT DOCUMENTS

| | | | |
|---|---|---|---|
| 379,027 | 3/1888 | Pickering | 404/45 |
| 1,472,521 | 10/1923 | Harrison | 404/41 X |
| 1,670,678 | 5/1928 | Cowper | 404/44 X |
| 2,336,235 | 12/1943 | Fischer | 404/44 X |
| 3,616,111 | 10/1971 | Raech, Jr. | 404/41 X |
| 4,111,585 | 9/1978 | Mascaro | 404/36 X |
| 4,596,731 | 6/1986 | Cudmore et al. | 404/41 X |
| 4,621,942 | 11/1986 | Hill | 404/41 |
| 4,629,358 | 12/1986 | Springston et al. | 404/44 X |
| 4,671,699 | 6/1987 | Roach | 404/41 |

FOREIGN PATENT DOCUMENTS

| | | | |
|---|---|---|---|
| 156053 | 10/1932 | Germany | 404/44 |

*Primary Examiner*—David J. Bagnell
*Assistant Examiner*—Frederick L. Lagman
*Attorney, Agent, or Firm*—Ted M. Anthony

[57] ABSTRACT

A reusable mat system for constructing roadways and equipment support surfaces comprising a plurality of uniform individual mats which are constructed of lightweight composite materials and which include strengthening agents. The individual mats partially overlap and interlock to form a continuous and substantially smooth surface, to prevent undesired movement of the mats on location, and to permit quick installation of the mats by simple placement methods.

4 Claims, 2 Drawing Sheets

MAT SYSTEM FOR CONSTRUCTION OF ROADWAYS AND SUPPORT SURFACES

BACKGROUND OF THE INVENTION

1. Field of the Invention

The present invention relates to a reusable system for the construction of roadways and equipment support surfaces in areas having poor ground integrity characteristics. More particularly, the present invention relates to a system of durable mats which can be interconnected to form roadways and/or equipment support surfaces. More particularly still, the present invention relates to a reusable system of mats which can be quickly and easily positioned in a single layer to form roadways and/or equipment support surfaces, and which can thereafter be easily removed and stored until needed again.

2. Description of the Related Art

Individual wooden boards have long been utilized to construct temporary roadways and equipment placement surfaces in remote and/or undeveloped areas where the terrain lacks sufficient integrity to properly support trucks or other heavy equipment. However, the use of individual wooden boards or planks for this purpose suffers from some very significant disadvantages. First, because such a large number of wooden boards are generally required to construct a roadway and/or equipment support surface, the use of wooden boards is typically very labor intensive, since each board must be individually positioned and then nailed or otherwise secured in place. Likewise, removal of said roadways and/or equipment support surfaces can also be a very time consuming and labor intensive process, since the boards must be separated or pulled apart prior to being removed from the location.

Second, the use of individual wooden boards to construct temporary roadways and equipment support surfaces in remote and/or undeveloped areas can also be very expensive, both in terms of the aforementioned labor requirements, as well as the raw materials which are needed to construct said roadways and support surfaces. A significant investment is often required to purchase enough wooden boards to construct the roadway and/or surface in question. Thereafter, once the boards have been installed, exposure of the boards to the elements, particularly in hot, humid environments such as marshes or wetlands where said board roads and surfaces are routinely utilized, invariably leads to degradation and deterioration of the wooden boards. For this reason, boards are often discarded after being used only once and, in particularly harsh environments, may even need to be replaced on location during the course of a particular job. Because new wooden boards are continuously needed to replace older boards that have decayed or deteriorated, the cost of said board roads and support surfaces seldom remains constant. Moreover, the continuous need for additional wooden boards also contributes to the depletion of a natural resource, i.e. timber stock, which in turn acts to drive up the cost of the new wooden boards which must be purchased.

Third, there are a great deal of functional problems associated with the use of individual wooden boards for the construction of temporary roadways and equipment support surfaces. For instance, because there are a number of seams between the individual boards, and also because the boards are subjected to different types of loading, the boards often tend to work themselves loose from each other. This can create large gaps in the roadway which in turn exposes the underlying terrain to the elements. Additionally, the nails which are used to secure the individual boards to each other often become exposed, thereby presenting a hazard to both the motorized and foot traffic using the roadway and/or support surface.

Fourth, use of individual wooden boards to construct roadways and/or equipment support surfaces also creates significant environmental concerns. Because wood is a highly absorbent material, wooden boards have a tendency to soak up the various contaminants which inevitably come in contact with said boards during the drilling process. These contaminants include a wide variety of substances, such as mud, drilling fluids, diesel, and oil and grease leaked from vehicles using the roadways and/or equipment support surfaces. When rain falls on these boards, these contaminants have a tendency to leech out of said boards and into the surrounding environment.

More recently, in an effort to overcome the problems associated with the use of separate wooden boards, a variety of mat systems have been developed. These systems generally utilize multi-layered wooden mats which can be laid down to form roadways or other support surfaces. These mats, which are typically constructed of individual boards or planks joined together in various configurations, interconnect or intermesh in order to form a continuous or nearly continuous roadway and/or support surface.

While these mat systems may arguably represent an improvement over the use of individual boards, the aforementioned conventional wooden mat systems still suffer from a number of very serious shortcomings. Although conventional mats may reduce labor requirements compared to individual wooden boards, significant amounts of time, effort and manpower are still needed to install said mats on location since most if not all of these conventional mat systems require the use of multiple layers. Thus, an initial layer must first be installed, then at least one additional layer of mats must be installed on top of said first layer. This multi-layer requirement leads to significant redundancy of effort in connection with both the installation and removal of said mats.

Additionally, the design of conventional mat systems can lead to degradation of the ground underlying said mats, as well as the structural integrity of the mats themselves. Because the individual mats of conventional mat systems are constructed of various configurations of wooden boards or planks, the mats all contain gaps or seams between said boards and/or planks. As rain falls on said mats, the rain water passes through the seams of said mats and mixes with the underlying soil to make mud. Trucks and other heavy equipment passing over the mats place a load on said mats which in turn can cause this mud to be pumped up through the numerous gaps or seams of the mats. This pumping action creates voids beneath the mats which, over time, can lead to severe deformities in the roadway surface. Because the mats bridge over these underlying voids, the mats thereafter have a tendency to break or splinter when subjected to normal loading.

Conventional wooden mats also suffer from significant rotting problems, because the mats can become inundated with rain water and various other contaminants from above, as well as mud from below. This mixture of water, mud and other contaminants can invade into the seams or gaps between the boards of said mats, causing the wooden mats to rot from within. As a result, just as with individual boards, conventional mats must be frequently repaired and, in some cases, entirely replaced. Although conventional mat systems are designed to be reusable, the mats are still subject to significant repair and replacement expense.

The design of these conventional mats often leads to significant environmental problems, because mud and other contaminants can saturate the mats and collect within the numerous seams or gaps of said mats. While this may not necessarily present a problem during the course of a particular job, these contaminants can be spread to other (often pristine) areas when the mats are utilized on subsequent jobs. Further, although many regulatory bodies require the use of retaining levees around drill sites, there is generally no such requirement for roadways. Thus, a conventional mat which is used at the drill site on one job (and which is exposed to all of the contaminants present at said drill site) may be used on a roadway for the next job. Because these roadway mats often contain contaminated mud from a previous job, these contaminants will be permitted to leech into the surrounding environment and, because there are generally no retaining levees around said roadways, this contamination may not even be subject to containment. While it may be desirable to wash these conventional mats after each job to prevent such environmental contamination, there is currently no cost-effective way of thoroughly cleaning these conventional mats.

Examples of existing mat systems are as follows:

Robishaw, U.S. Pat. No. 2,639,650, discloses a series of metal mats, which provide a corrugated surface. This patent provides a discontinuous bearing surface for contact with the terrain, and does not provide a substantially smooth working surface. Furthermore, assembly of this mat system requires intricate fitting by side-to-side sliding action and fitting of numerous corresponding corrugated shapes. The Robishaw patent does not provide connecting means for lateral mat placement.

Smith, U.S. Pat. No. 2,652,753, discloses a series of wooden mats of multiple layers constructed of wooden boards, intermittently-spaced longitudinally to provide an intermeshing end to end connection.

Leyendecker, U.S. Pat. No. 2,819,026 discloses a mat system comprising a plurality of wooden sections interfitted in a longitudinal manner and retained by lateral strapping means. Assembly of this system requires "weaving" of a strapping means between adjacent connected sections. Further, the disclosures make no provision for lateral section attachment or connection.

Hart, U.S. Pat. No. 2,912,909, discloses a mat system comprising a plurality of wooden sections interfitted in longitudinal and lateral manners to create substantially flush upper and lower surfaces. To effect a substantially continuous contact layer support, alternating sections must be precisely placed at measured distances from each other to facilitate later placement of the interconnecting system.

Davis, et al, U.S. Pat. No. 4,289,420, discloses a wooden mat for use as a temporary roadway comprising longitudinally and laterally spaced interdigitated boards. This system requires intricately precise relative placement of each mat section involving substantial installation time. Further, this disclosure makes provision for lateral expansion in only a single lateral direction.

Penland, Sr., U.S. Pat. No. 4,462,712 discloses a method and apparatus for construction of a flooring system comprising a plurality of wooden boards with longitudinally locking tabs and slots. This patent makes no disclosure of means to facilitate lateral connection or expansion of said flooring mats.

Waller, Jr., U.S. Pat. No. 4,600,336, discloses an interlocking wooden mat system comprising wooden mats with intermeshing longitudinal and lateral boards retained by tie-in planks nailed to the main mat sections. Disclosures of this patent reveal interconnecting means requiring intricate and complex assembly procedures involving substantial installation time.

Hicks, U.S. Pat. No. 4,875,800 discloses a system identically similar individual mats, each comprised of a layer of parallel boards attached to a half layer of parallel boards disposed perpendicular to the first layer. When two layers of these mats are laid together a 3-layer surface is formed.

Similarly, U.S. Pat. No. 4,973,193 to Watson, et al, U.S. Pat. No. 5,020,937 to Pouyer; U.S. Pat. No. 5,032,037 to Phillips, et al; and U.S. Pat. No. 5,273,373 to Pouyer all disclose mat systems comprising individual mats constructed of various configurations of boards or cross-members. Each of these patents disclose mat systems which must be installed in multiple layers. Moreover, each of these patents disclose mats which are permeable and, thus, susceptible of being invaded by water, mud and other contaminants.

Springston, et al, U.S. Pat. No. discloses a system of portable mats for the construction of runways and other support surfaces. The mats disclosed in this patent must be joined together using bolts or other means.

SUMMARY OF THE INVENTION

The mat system of the present invention is a durable, reusable mat system which can be utilized to construct roadways and other support surfaces. Moreover, the mat system of the present invention can be horizontally expanded in all lateral and longitudinal directions to provide the desired coverage by the roadway or other support surface being constructed. Due to the uniform outward configuration of the individual mats of the present invention, a roadway and/or other support surface can be installed in a single layer by simple placement of the individual mats. Additionally, this uniform outward configuration allows for great flexibility in the installation process. These qualities greatly reduce the time, expense and labor requirements associated with installing and removing the disclosed invention.

The mat system of the present invention further comprises individual mats which are impermeable, so that fluids cannot seep through said mats. For this reason, the pumping effect described above is effectively eliminated, and deterioration of the underlying terrain is thereby greatly reduced. The individual mats of the mat system of present invention are also lighter than mats of conventional mat systems, which allows for more efficient and economical transportation of said mats to and from installation locations.

Because the mats of the present invention possess substantially smooth working surfaces there are no gaps for mud and other contaminants to accumulate. Further, because of these smooth outer surfaces, the mats of the present invention can be easily washed to remove any mud or other contaminants which do collect on said mats. These qualities prevent the spread of contaminants from one location to another.

It is possible that the mat system of the present invention could be constructed substantially out of wood. The individual mats of such an embodiment would have at least two plies, and would further have at least one layer of impermeable material between said plies so that water and other fluids could not seep through said mats.

It is therefore an object of the present invention to provide a durable, reusable mat system which can be utilized to construct roadways or other support surfaces.

It is a further object of the present invention to provide a mat system wherein horizontal expansion of the desired roadway and/or equipment support surface is accommodated in all longitudinal and lateral directions.

It is a further object of the present invention to provide a mat system wherein the individual mats of said system are restrained from horizontal movement by frictional contact with the underlying terrain, and mechanical contact with adjoining mats, such that additional restraining means are not required.

It is a further object of the present invention to provide a mat system comprising a plurality of uniform and wholly interchangeable individual mats which can be installed by simple relative placement.

It is a further object of the present invention to provide a fully functional mat system which is installed in a single layer.

It is a further object of the present invention to provide a mat system comprising a plurality of lightweight mats which can be easily installed, and which permit efficient transportation of said mats to and from installation sites.

It is a further object of the invention to provide a mat system comprising a plurality of impermeable mats having substantially smooth working surfaces to prevent the accumulation of foreign substances, and to facilitate cleaning of said mats.

Other and additional objects of the invention are apparent throughout the details of construction and operation as more fully described herein and illustrated in the accompanying drawings.

DESCRIPTION OF PREFERRED EMBODIMENT

Figure 1:
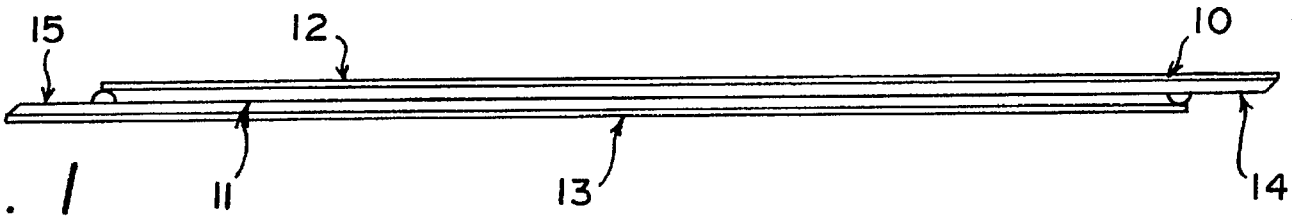
FIG. 1 is a side view of a mat of the present invention.

Referring to FIG. 1, the preferred embodiment of the mat system of the present invention comprises a plurality of uniform mats having upper section 10 and lower section 11. Upper section 10 has upper work surface 12, while lower section 11 has lower work surface 13. Although upper work surface 12 and lower work surface 13 are depicted as being substantially smooth, minor indentations or raised portions may be added to said work surfaces to increase traction characteristics. Upper section 10 and lower section 11 are mutually offset relative to each other, which results in upper peripheral extension 14 and lower peripheral extension 15. In the preferred embodiment, outer edges of upper section 10 and lower section 11 are bevelled along the full extent of said edges.

Figure 2:
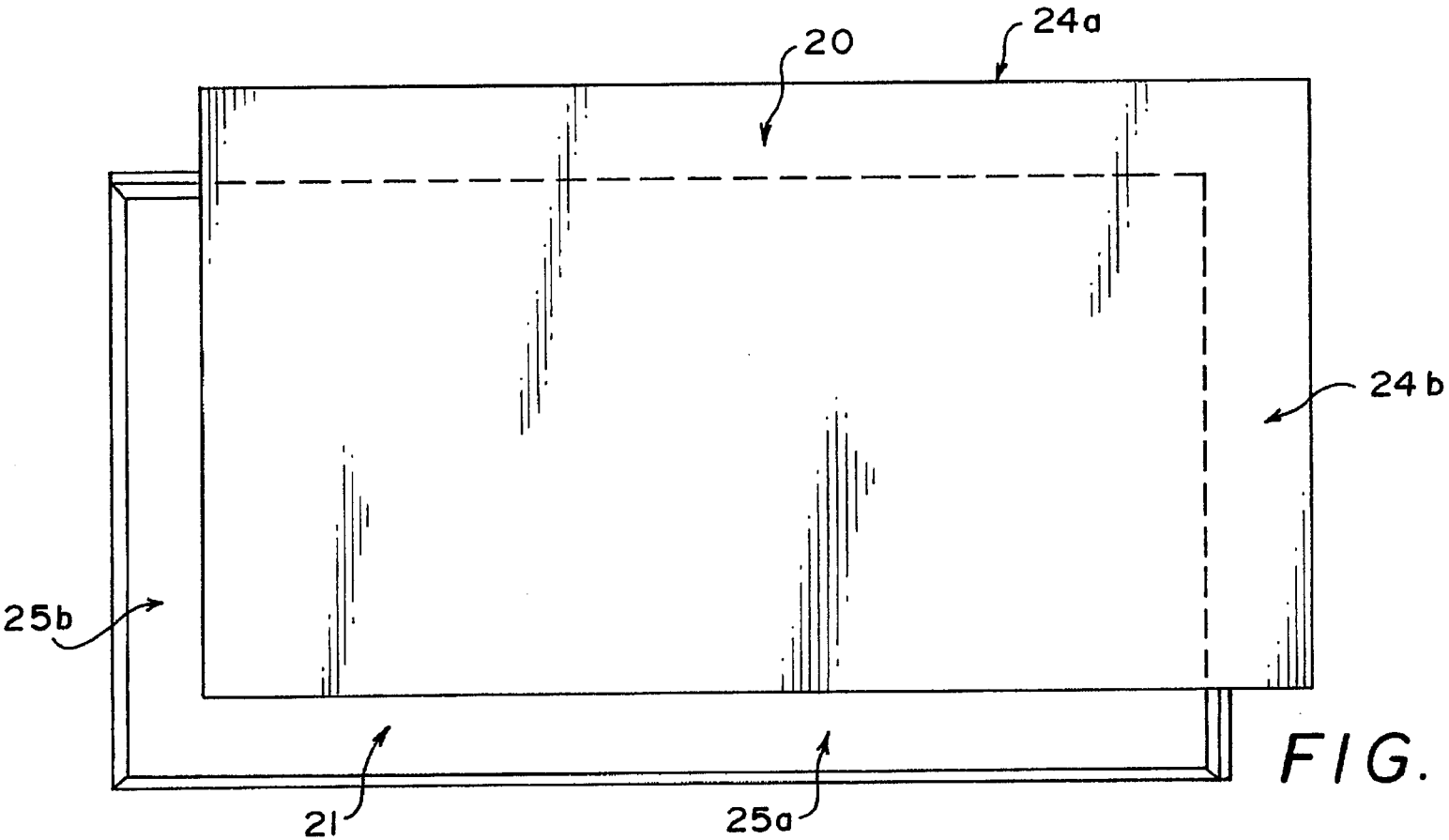
FIG. 2 is a top plan view of a mat of the present invention.

FIG. 2 depicts upper section 20 and lower section 21, as well as upper peripheral extensions 24*a* and 24*b* and lower peripheral extension 25*a* and 25*b*. When two mats of the preferred embodiment are laterally placed together for purposes of constructing a roadway or other support surface, lower peripheral extension 25*a* is received under upper peripheral extension 24*a* of an adjacent mat. Similarly, when two mats are placed together in longitudinal fashion, lower peripheral extension 25*b* is received under upper peripheral extension 24*b*.

When a plurality of mats are joined together, said mats form a continuous and substantially smooth roadway or other support surface. Further, the overlap/underlap relationship shared by adjacent mats provides strength for load support purposes. Additionally, said overlap/underlap relationship also provides increased friction contact between mats to prevent separation of said mats.

Figure 3:
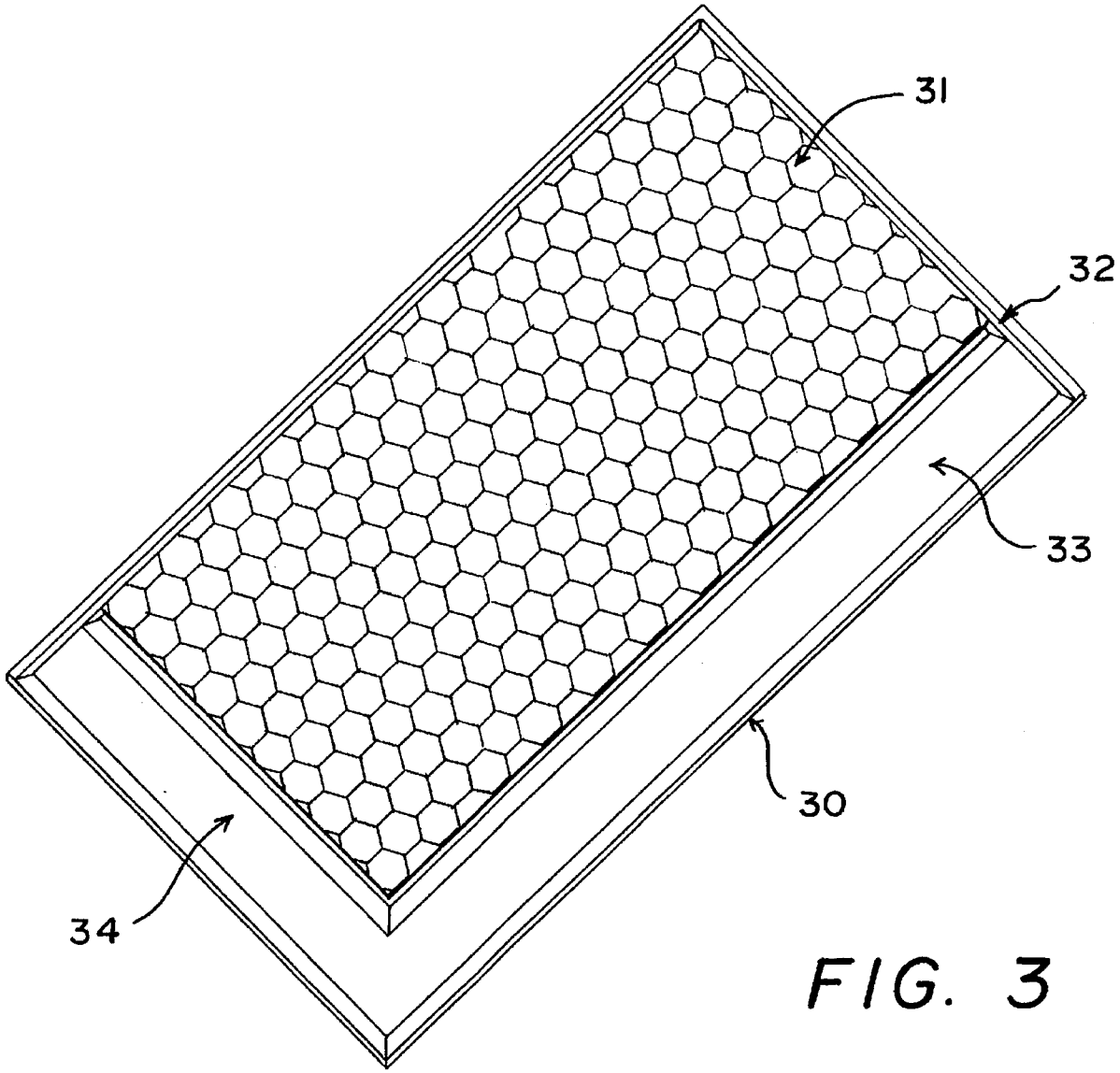
FIG. 3 is a top cutaway view of the mat of the present invention.

Although it is possible that the mats of the present invention can be constructed of solid material, in the preferred embodiment said mats are comprised of two mirror-image components which are affixed together to form a single mat. FIG. 3 depicts lower section 30, having area of reduced material 31. While area of reduced material 31 is depicted as a honeycomb configuration in FIG. 3, it is possible that said area could have any number of configurations. Bevelled ridge 32 extends along the inner edges of the area of reduced material 31. Edges 33 and 34 are constructed of solid material.

In the preferred embodiment, lower section 30 is joined with and affixed to a mirror-image section. Said sections are oriented such that area of reduced material 31 is aligned with the area of reduced material of said upper mirror-image section, and so that only these sections of reduced material overlap. This orientation results in solid edges 33 and 34 forming lower peripheral extensions. Similarly, the solid edges of the mirror-image section form upper peripheral extensions.

While the mat system of the present invention can be constructed of any number of materials, in the preferred embodiment the mats disclosed herein are constructed of composite materials. Said composite materials could include virgin resins, and/or plastics, as well as re-claimed polyolefins and/or vulcanized rubber. In the preferred embodiment, said mats may also include strengthening agents such as fiberglass, steel, graphite, nylon, or some combination thereof.

Whereas the invention is herein described with respect to a preferred embodiment, it should be realized that various changes may be made without departing from essential contributions to the art made by the teachings hereof.

What is claimed is:

1. A mat system for constructing roadways and support surfaces comprising a plurality of impermeable, partially overlapping and interconnectable individual mats, wherein each mat comprises:

a. a substantially rectangular lower layer;

b. a substantially rectangular upper layer affixed to said lower layer, wherein said upper and lower layers are offset from each other to form an upper peripheral extension on two adjacent sides of said mat, and a lower peripheral extension on the two remaining sides of said mat and wherein said lower layer contains an area of reduced material on the upper face of said lower layer, said upper layer contains an area of reduced material on the lower face of said upper layer, and said areas of reduced material are aligned adjacent to each other.

2. A mat system as recited in claim 1, wherein said areas of reduced material exhibit a honeycomb configuration.

3. A mat system as recited in claim 2, wherein said individual mats are constructed of composite materials.

4. A mat system as recited in claim 3, wherein said upper and lower layers contain strengthening agents.

* * * * *